US005816456A

United States Patent [19]

Graffin

[11] Patent Number: 5,816,456

[45] Date of Patent: Oct. 6, 1998

[54] LAMINAR FLOW FILLER SPOUT

[75] Inventor: André Graffin, La Chapelle Du Bois, France

[73] Assignee: Serac Group, LaFerte Bernard, France

[21] Appl. No.: 670,430

[22] Filed: Jun. 26, 1996

[30] Foreign Application Priority Data

Jul. 5, 1995 [FR] France ..... 95 08106

[51] Int. Cl.[6] ..... B67D 3/00

[52] U.S. Cl. ..... 222/559; 222/564; 137/614.18

[58] Field of Search ..... 222/504, 506, 222/509, 518, 545, 547, 564, 559; 239/553, 583, 590; 137/614.18, 614.19

[56] References Cited

U.S. PATENT DOCUMENTS 4,617,955 10/1986 Melgaard ..... 137/614.18
4,655,253 4/1987 Ourensma ..... 137/614.18
5,137,187 8/1992 Nichols et al. .
5,228,604 7/1993 Zanini et al. ..... 222/504

FOREIGN PATENT DOCUMENTS 43074 12/1973 Australia ..... 222/504
0389065 3/1990 European Pat. Off. .
0559513 2/1993 European Pat. Off. .

*Primary Examiner*—Philippe Derakshani
*Attorney, Agent, or Firm*—Griffin, Butler, Whisenhunt & Kurtossy

[57] ABSTRACT

A tubular body has a conical wall portion adjacent to a flow orifice. A conical valve member disposed facing the conical wall portion is connected to a position control member. A flow rate regulation member disposed upstream from the valve member relative to the fluid flow direction is connected to a position control member independent from the position control member of a valve member.

5 Claims, 1 Drawing Sheet

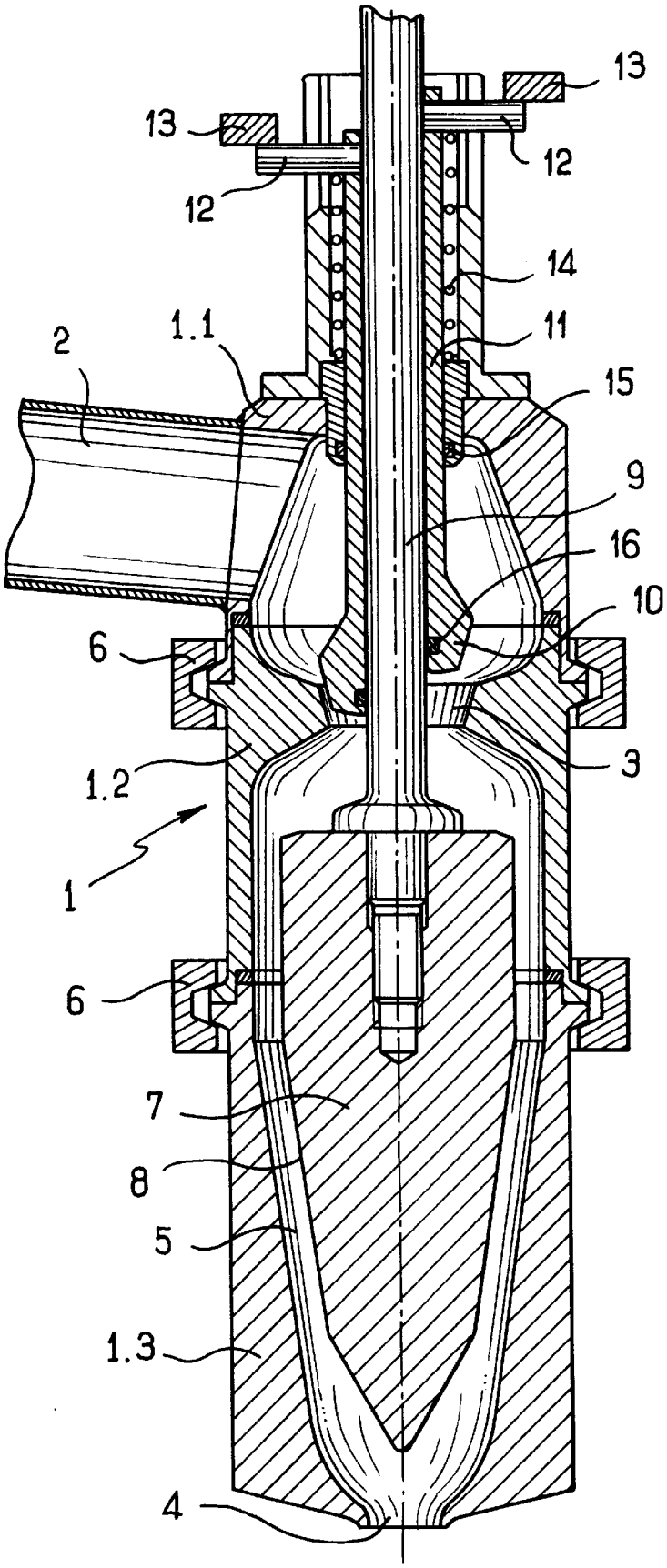
13
13
12
12
14
11
2
1.1
15
9
16
10
6
3
1.2
1
6
7
8
5
1.3
4

LAMINAR FLOW FILLER SPOUT

BACKGROUND OF THE INVENTION

Filler spouts are known that comprise a tubular body having a conical wall portion adjacent to a flow orifice, and a conical valve member disposed facing the conical wall portion and connected to a member for controlling the position of the valve member. When it is desired to vary the flow rate of the liquid dispensed by the filler spout, the position of the valve member relative to the tubular body is changed so as to increase or decrease the section of the space between the conical valve member and the facing conical wall portion. Such devices are satisfactory from the point of view of flow rate regulation. However, when the valve member is positioned to set the filler spout to a small flow rate, the space between the conical valve member and the facing conical wall portion is of very small width, and when the liquid to be dispensed is fed under high pressure, this gives rise to a large increase in the speed of the liquid through the narrow passage, which causes the flow to become turbulent, thereby generating foam, and to take up a shape that is difficult to control so that there is a danger of liquid splashing outside the neck of the receptacle for receiving it.

OBJECTS AND SUMMARY OF THE INVENTION

According to the invention, a filler spout of the above-specified type is proposed in which, upstream from the valve member relative to the flow direction of the substance, the filler spout includes a flow rate regulation member co-operating with a facing wall portion to define a passage of section that varies as a function of the position of a flow rate regulation member, the flow rate regulation member being connected to a position control member that is independent of the position control member of the valve member.

Thus, the flow rate regulation member establishes head-loss that increases with decreasing flow rate such that regardless of the flow rate and whatever the flow speed in the flow rate regulation member, it is possible to find a corresponding position of the valve member which makes it possible to obtain a flow that is laminar at the outlet from the filler spout.

In an advantageous version of the invention, the position control members for the valve member and for the flow rate regulation member extend parallel to each other. This minimizes disturbances generated by the control members in the flow of liquid through the filler spout.

In a preferred embodiment of the invention, the position control member of the valve member comprises a control rod extending along the axis of the tubular body, and the position control member of the flow rate regulation member comprises a control tube surrounding the control rod. This eliminates any element extending across the flow and further minimizes disturbances to the flow.

BRIEF DESCRIPTION OF THE DRAWING

Other characteristics and advantages of the invention appear on reading the following description of a particular and non-limiting embodiment of the invention described with reference to the sole accompanying FIGURE which is an axial section view of a filler spout of the invention, the lefthand half being shown with the flow rate regulation member in a low flow rate position while the righthand half is shown with the flow rate regulation member in a high flow position.

MORE DETAILED DESCRIPTION

With reference to the FIGURE, the filler spout of the preferred embodiment as shown comprises a generally tubular body referenced 1 made up of three portions: a feed portion 1.1 into which there opens a feed duct 2 extending transversely relative to the tubular body; a flow rate regulation portion 1.2 including a constriction 3; and an on/off portion 1.3 whose bottom end includes a flow orifice 4. Upstream from the flow orifice 4, the terminal portion 1.3 of the tubular body includes a conically-shaped inside wall portion 5. The lengths 1.1, 1.2, and 1.3 are connected to one another by couplings 6 enabling the filler spout to be disassembled and reassembled quickly.

Inside the filler spout, there is a valve member 7 having a conical portion 8 that extends facing the conical portion 5 of the tubular wall and connected to a control rod 9 which extends along the axis inside the tubular body and which is connected to an actuator member (not shown).

Facing the constriction 3, the filler spout includes a flow rate regulation member 10 mounted to slide on the control rod 9 and associated with a control tube 11 whose outside end includes lugs 12 that project radially and that are positioned under the control of cams 13. In the preferred embodiment as shown, the flow rate regulation member 10 is returned resiliently towards a maximally open position by means of a spring 14 whose bottom end bears against the top portion of the tubular body and whose top end bears against the control lugs 12.

As a result of this structure, the position of the valve member 7 and the position of the flow rate regulation member 10 can be controlled independently so that it is possible to cause the filler spout to operate at all times with the valve member 7 in a position relative to the wall 5 such that the flow in the gap between the conical portion 8 of the valve member 7 and the conical portion 5 of the tubular body 1 is always returned to laminar conditions while the flow rate regulation member 10 serves to adjust the flow rate that flows out in the end through the flow orifice 4. In this context, it should be observed that the transverse position of the feed orifice 2 encourages optimum flow through the filler spout by minimizing any risk of a vortex being established inside the filler spout.

The resilient return of the flow rate regulation member towards a maximally open position by the spring 14 serves to ensure that in the absence of any flow rate regulation control, e.g. when cleaning the filler spout, the maximum flow rate of the liquid can flow through the filler spout.

Naturally, the invention is not limited to the embodiment described and variants may be applied thereto without going beyond the scope of the invention as defined by the claims.

In particular, although the invention is described as having mechanical control members, it is possible to provide magnetic control members that make it possible to omit the sealing gaskets 15 and 16 respectively disposed between the tubular body and the control tube 11, and between the flow rate regulation member 10 and the control rod 9.

It is claimed:

1. A filler spout having a tubular body with at least one conical wall portion adjacent to a flow orifice, and a conical valve member disposed facing the conical wall portion and connected to a member for controlling the position of the valve member, wherein upstream from the valve member relative to the flow direction through the spout, there is a flow rate regulation member cooperating with a facing wall portion to define a passage of section that is variable as a function of the position of the flow rate regulation member, and wherein the flow regulation member is connected to a position control member independent of the position control member for the valve member.

2. A filler spout according to claim 1, wherein the position control members for the valve member and for the flow rate regulation member extend parallel to each other.

3. A filler spout according to claim 1, wherein the position control member of the valve member comprises a control rod extending along the axis of the tubular body, and wherein the position control member of the flow rate regulation member comprises a control tube surrounding the control rod.

4. A filler spout according to claim 1, including a return member for returning the flow rate regulation member towards a maximally open position.

5. A filler spout according to claim 1, including a feed duct extending transversely to the tubular body.

* * * * *